US005464154A

United States Patent [19]

Nielsen

[11] Patent Number: 5,464,154

[45] **Date of Patent: * Nov. 7, 1995**

[54] METHODS FOR SPRAYING POLYMERIC COMPOSITIONS WITH COMPRESSED FLUIDS AND ENHANCED ATOMIZATION

[75] Inventor: Kenneth A. Nielsen, Charleston, W. Va.

[73] Assignee: Union Carbide Chemicals & Plastics Technology Corporation, Danbury, Conn.

[ * ] Notice: The portion of the term of this patent subsequent to Jan. 12, 2010, has been disclaimed.

[21] Appl. No.: 129,256

[22] Filed: Sep. 29, 1993

[51] Int. Cl.[6] ..... B05B 17/04

[52] U.S. Cl. ..... 239/1; 239/597

[58] Field of Search ..... 239/1, 8, 589, 239/590, 597, 601

[56] References Cited

U.S. PATENT DOCUMENTS

| | | | |
|---|---|---|---|
| 3,556,411 | 1/1971 | Nord et al. | 239/599 X |
| 3,647,147 | 3/1972 | Cook | 239/601 X |
| 3,659,787 | 5/1972 | Ito | 239/601 X |
| 3,737,108 | 6/1973 | Stumphauzer et al. | 239/601 X |
| 3,754,710 | 8/1973 | Chimura | 239/601 X |
| 3,843,055 | 10/1974 | Nord et al. | 239/601 X |
| 4,097,000 | 6/1978 | Derr | 239/601 X |
| 4,258,885 | 3/1981 | Legeza | 239/601 X |
| 4,346,849 | 8/1982 | Rood | 239/601 X |
| 4,582,731 | 4/1986 | Smith | 427/421 |
| 4,618,101 | 10/1986 | Piggott | 239/589 |
| 4,646,977 | 3/1987 | Iwamura et al. | 239/601 X |
| 4,734,227 | 3/1988 | Smith | 264/13 |
| 4,734,451 | 3/1988 | Smith | 524/493 |
| 4,882,107 | 11/1989 | Cavender et al. | 264/51 |
| 4,923,720 | 5/1990 | Lee et al. | 427/422 |
| 5,009,367 | 4/1991 | Nielsen | 239/3 |
| 5,027,742 | 7/1991 | Lee et al. | 118/300 |
| 5,057,342 | 10/1991 | Hoy et al. | 427/422 |
| 5,066,522 | 11/1991 | Cole et al. | 427/422 |
| 5,098,194 | 3/1992 | Kuo et al. | 366/144 |
| 5,106,650 | 4/1992 | Hoy et al. | 427/27 |
| 5,108,799 | 4/1992 | Hoy et al. | 427/422 |
| 5,141,156 | 8/1992 | Hoy et al. | 239/135 |
| 5,167,371 | 12/1992 | Rohner | 239/601 X |
| 5,170,727 | 12/1992 | Nielsen | 110/346 |
| 5,171,613 | 12/1992 | Bok et al. | 427/422 |
| 5,178,325 | 1/1993 | Nielsen | 239/1 |
| 5,211,342 | 5/1993 | Hoy et al. | 239/707 |
| 5,290,603 | 3/1994 | Nielsen et al. | 427/421 |

*Primary Examiner*—Andres Kashnikow
*Assistant Examiner*—Lesley D. Morris
*Attorney, Agent, or Firm*—M. N. Reinisch

[57] ABSTRACT

The present invention is directed to methods for spraying polymeric compositions with supercritical or subcritical compressed fluids such as carbon dioxide or ethane over a wider range of spray conditions to provide improved spray application quality with reduced emission of solvent. The methods are accomplished by using an elongated spray orifice to transform narrow, fishtail, liquid-film sprays to wider, feathered, decompressive sprays.

20 Claims, 4 Drawing Sheets

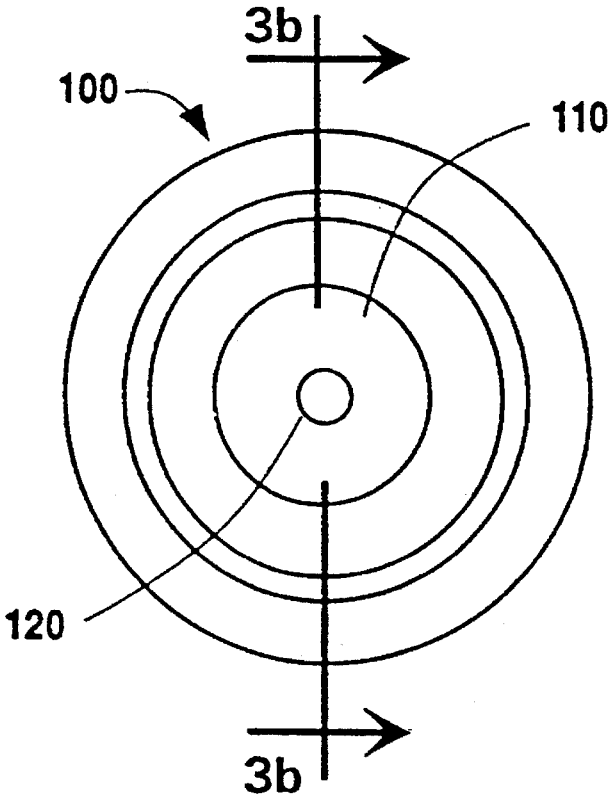
FIG. 3a
FIG. 3b
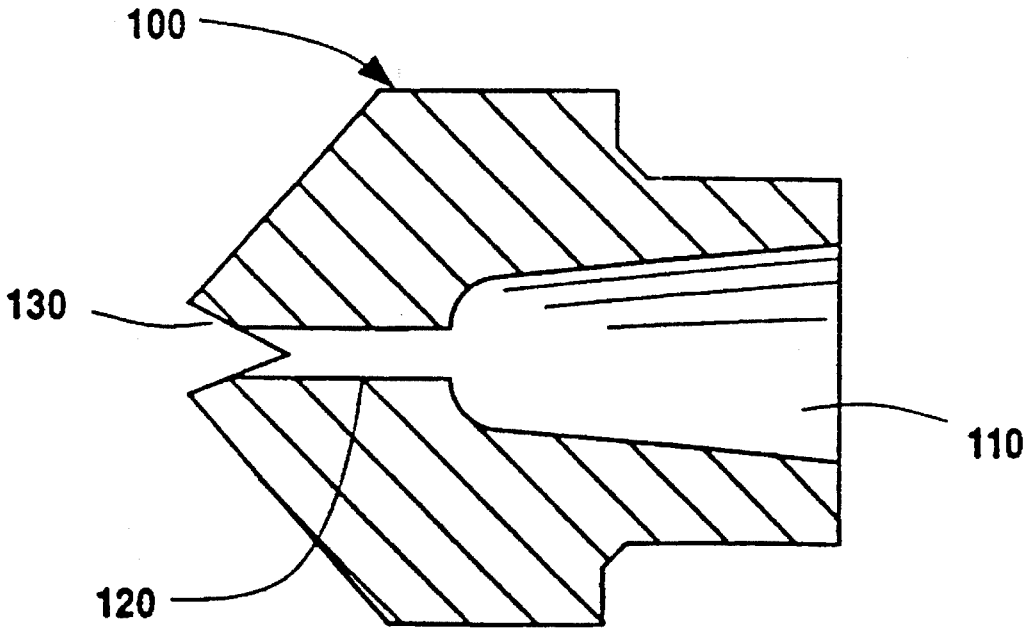

METHODS FOR SPRAYING POLYMERIC COMPOSITIONS WITH COMPRESSED FLUIDS AND ENHANCED ATOMIZATION

FIELD OF THE INVENTION

This invention, in general, pertains to the field of spraying polymeric compositions with reduced emission of volatile organic solvent. More particularly, the present invention is directed to methods for spraying polymeric compositions using supercritical fluids or subcritical compressed fluids, such as carbon dioxide or ethane, under conditions that enhance atomization.

BACKGROUND OF THE INVENTION

Many industrial processes spray compositions that contain viscous or solid polymeric components, such as coatings, adhesives, release agents, additives, gel coats, lubricants, and agricultural materials. To spray such materials, it has been common practice to use relatively large amounts of organic solvents. The solvents perform a variety of functions, such as to dissolve the polymers; to reduce viscosity for spraying; to provide a carrier medium for dispersions; and to give proper flow when the composition is sprayed onto a substrate, such as coalescence and leveling to form a smooth coherent coating film. However, the solvents released by the spray operation are a major source of air pollution. There are several patents which disclose new spray technology that can markedly reduce organic solvent emissions, by using environmentally acceptable supercritical fluids or subcritical compressed fluids, such as carbon dioxide or ethane, to replace the solvent fraction in solvent-borne compositions that is needed to obtain low spray viscosity: U.S. Pat. Nos. 4,923,720 and 5,108,799 disclose methods for using supercritical fluids for the spray application of coatings. U.S. Pat. No. 5,106,650 discloses methods for using supercritical carbon dioxide for the electrostatic spray application of coatings. U.S. Pat. No. 5,009,367 discloses methods for using supercritical fluids for obtaining wider airless sprays. U.S. Pat. No. 5,057,342 discloses methods for using supercritical fluids for obtaining feathered airless sprays. U.S. Pat. No. 4,882,107 discloses methods for using supercritical fluids to apply mold release agents, such as in the production of polyurethane foam. U.S. Pat. No. 5,066,522 discloses methods for using supercritical fluids to apply adhesive coatings. U.S. Pat. No. 5,171,613 discloses methods for maintaining a feathered airless spray pattern obtained using supercritical fluids by preventing cooling of the coating mixture before it is sprayed. U.S. Pat. No. 5,178,325 discloses methods for using supercritical fluids or subcritical compressed fluids for coating substrates in which the average spray velocity of a decompressive spray is reduced by using an elongated spray orifice.

Smith, in U.S. Pat. No. 4,582,731, issued Apr. 15, 1986; U.S. Pat. No. 4,734,227, issued Mar. 29, 1988; and U.S. Pat. No. 4,734,451, issued Mar. 29, 1988; discloses methods and apparatus for the deposition of thin films and the formation of powders through the molecular spray of solutes dissolved in supercritical fluid solvents, which may contain organic solvents. The concentration of said solutes are described as being quite dilute; on the order of 0.1 percent. In conventional applications, the solute concentration is normally 50 times or more greater than this level.

The molecular sprays disclosed in the Smith patents are defined as a spray "of individual molecules (atoms) or very small clusters of solute" which are in the order of about 30

Angstroms in diameter. These "droplets" are more than $10^6$ to $10^9$ less massive than the droplets formed in conventional methods that Smith refers to as "liquid spray" applications.

Supercritical fluids and subcritical compressed fluids have also been used with fuel sprays. Nielsen, in U.S. Pat. No. 5,170,727, issued Dec. 15, 1992, discloses methods for using supercritical fluids as diluents in combustion of liquid fuels and waste materials. Zhen, et al., in "The Atomization Behavior of Fuel Containing Dissolved Gas", a paper submitted to Atomization and Sprays, discloses the atomization of diesel fuel containing air or carbon dioxide dissolved under pressure at room temperature. Using this very low viscosity fuel, which contains no polymers, they studied the effect of pressure and nozzle length on droplet size, spray angle, and discharge coefficient for a diesel injector nozzle.

The conventional atomization mechanism of airless sprays is well known and is discussed rand illustrated by Dombroski, et al., in *Chemical Engineering Science* 18:203 (1963). The coating exits the orifice as a liquid film that becomes unstable from shear induced by its high velocity relative to the surrounding air. Waves grow in the liquid film, become unstable, and break up into liquid filaments that likewise become unstable and break up into droplets. Atomization occurs because cohesion and surface tension forces, which hold the liquid together, are overcome by shear and fluid inertia forces, which break it apart. This process is shown photographically for an actual paint in the brochure entitled "Cross-Cut™ Airless Spray Gun Nozzles", Nordson Corporation, Amherst, Ohio. Often the liquid film extends far enough from the orifice to be visible before atomizing into droplets. The sprays are generally angular in shape and have a relatively narrow fan width, that is, a fan width that is not much greater than the fan width rating of the spray tip being used. As used herein, the terms "liquid-film spray" and "liquid-film atomization" refer to a spray, spray fan, or spray pattern in which atomization occurs by this conventional mechanism.

In liquid-film atomization, however, the cohesion and surface tension forces are not entirely overcome and they can profoundly affect the spray, particularly for viscous coating compositions. Conventional airless spray techniques are known to produce coarse droplets and defective spray fans that limit their usefulness to applying low-quality coating films. Higher viscosity increases the viscous losses that occur within the spray orifice, which decreases the energy available for atomization. It also decreases shear intensity, which hinders the development of natural instabilities in the expanding liquid film. This delays atomization so that relatively large droplets are formed. The spray also characteristically forms a "tailing" or "fishtail" spray pattern. The surface tension and cohesive forces in the liquid film tend to gather liquid at the edges of the spray fan, which produces coarsely atomized jets of coating. Sometimes the jets separate from the spray and deposit separate bands of coating. At other times they thicken the edges so that more coating is deposited at the top and bottom than in the center of the spray. These deficiencies produce a nonuniform deposition pattern that makes it difficult to apply a uniform coating.

It is well known that liquid-film atomization can be improved if the liquid is made turbulent or agitated before it passes through the atomization orifice of the airless spray tip. Turbulent or agitated flow of the liquid as it exits the orifice promotes destabilization and disruption of the liquid film, which causes it to break up more readily into finer droplets and into a more uniform spray. For this reason, various types of turbulence promoters have been designed for use with conventional airless spray tips. Such turbulence promoters include various types of pre-orifices, diffusers, turbulence plates, restrictors, flow splitters/combiners, flow impingers, screens, baffles, vanes, and other inserts, devices, and flow networks known to those skilled in the art. Examples of turbulence promoters and the turbulent flow created in the spray tip are illustrated in the catalog entitled "Airless Nozzles and Accessories", Nordson Corporation, Amherst, Ohio. One such example is a turbulence plate that is inserted into the inlet of the airless spray tip, wherein it divides the flow into two high velocity streams that impinge against one another head on at a ninety-degree angle to the main flow direction. The turbulent discharge then flows through the atomization orifice. Another such example is a restrictor plate that contains a pre-orifice that is somewhat larger in diameter than the atomization orifice. It is so positioned behind the atomization orifice to create a liquid jet that discharges against the atomization orifice, thereby generating the desired turbulence.

Thus, to improve liquid-film atomization, conventional airless spray tips are designed to maximize velocity and turbulence as the liquid flows through the atomization orifice, for a given pressure drop across said orifice. In particular, in one important design standard, the flow path in the orifice is made very short in order to minimize flow resistance and reduction in turbulence. Furthermore, in addition to being used with turbulence promotion devices, conventional spray tips themselves are sometimes designed to promote turbulent or agitated flow of the liquid at the entrance to the atomization orifice. For example, the spray tip chamber that feeds liquid to the atomization orifice may be contoured such that liquid flows coming from opposite sides of the chamber converge and impact each other as they flow into the atomization orifice.

The most commonly used airless spray tip design is sometimes called a dome-style spray tip. Such a spray tip is disclosed in, for example, U.S. Pat. No. 4,097,000, issued Jun. 27, 1978. The spray tip of this prior art embodiment is described and illustrated in FIGS. 1*a*, 1*b*, and 1*c* of the aforementioned commonly assigned U.S. Pat. No. 5,178,325 and is not a part of the present invention. The figures illustrate fluid flow patterns within the feed passageway and through the orifice, which clearly demonstrate the aforementioned flow convergence and impaction. The orifice piece is typically made from a tungsten carbide casting. The feed passageway is a hollow dome-shaped chamber centered about the flow axis of the spray tip. This hollow dome is formed in the spray orifice body before final hardening. The hollow dome extends nearly the length of the spray orifice body to such a depth that the roof or wall has the desired thickness at the convergent end. The orifice is sometimes formed by cutting a v-shaped groove across the outside end of the dome such that the groove intersects and cuts into the hollow end of the dome. This creates an orifice with an elliptical, circular, or similarly shaped cross-section of very short length. The size (cross-sectional area) of the orifice is determined by the depth of the v-shaped groove; that is, a larger orifice passageway produces a larger flow rate.

The angle of the v-shaped groove regulates the fan width of the spray, as is known to those skilled in the art. A smaller angle (narrower groove) produces a wider fan. A larger angle (wider groove) produces a narrower fan.

Still another dome-style spray tip is disclosed, for example, in U.S. Pat. No. 3,556,411, issued Jan. 19, 1971, which is described and illustrated in FIGS. 2*a* and 2*b* of the aforementioned U.S. Pat. No. 5,178,325, and which represents embodiments which are not in accordance with the present invention. The first figure shows a spray nozzle assembly with a turbulence plate that discharges into the spray orifice body to promote turbulent flow through the spray orifice. The second figure shows an example of a spray orifice body that can be used in the spray nozzle assembly. It has a circular converging feed passageway that is intersected by a groove to form the orifice passageway.

Other types of dome-style spray tips, which have different mechanical features so as to produce a desired spray pattern, are disclosed in U.S. Pat. No. 3,647,147, issued Mar. 7, 1972; U.S. Pat. No. 3,659,787, issued May 2, 1972; U.S. Pat. No. 3,737,108, issued Jun. 5, 1973; U.S. Pat. No. 3,843,055, issued Oct. 22, 1974; and U.S. Pat. No. 3,754,710, issued Aug. 28, 1973.

A more recent airless spray tip design is called a Cross-Cut™ type spray tip, which is disclosed in U.S. Pat. No. 4,346,849, issued Aug. 31, 1982. It is illustrated in FIG. 3 of the aforementioned U.S. Pat. No. 5,178,325, which is also not in accordance with the present invention. It is made by cutting interpenetrating grooves, at right angles to each other, into opposite sides of a tungsten carbide spray orifice body. The groove on the pressurized or inlet side is wedge-shaped in cross-section. The groove on the unpressurized or exit side has a bottom portion that is trapezoidal in cross-section. The orifice passageway is formed by the interpenetration of the two grooves. This gives a rectangular-shaped spray orifice passageway that has very short flow path length. The width of the outer groove regulates the fan width of the spray.

From the foregoing prior art, it is clear that the design of airless spray nozzles teaches, in part, that it is desirable to maintain a very short orifice path length in order to maximize turbulent flow from the spray orifice.

All of these prior airless spray nozzle designs are directed to spraying conventional coating compositions. None of them uses supercritical fluids or subcritical compressed fluids as diluents to spray polymeric compositions.

The aforementioned Smith patents, which are directed to producing fine solid films and powders by using a "molecular" spray, disclose an apparatus which has an apparently elongated heated probe located within the sample collection chamber between the orifice and a transfer line coming from the heating oven. In particular, in the aforementioned Smith U.S. Pat. No. 4,734,227, it is taught that the process utilizes a fluid injection technique which calls for rapidly expanding the supercritical solution through a short orifice into the relatively lower pressure region. The text teaches away from use of long orifice designs because, as noted, more conventional nozzles or longer orifice designs would enhance solvent cluster formation, which is taught as being undesirable. Consequently, the function of the apparently elongated probe is to convey, within the sample collection chamber, the fluid between the transfer line, located outside of said chamber, and the prescribed short orifice.

As disclosed in the aforementioned patents, supercritical fluids or subcritical compressed fluids such as carbon dioxide or ethane are not only effective viscosity reducers, they can produce a new airless spray atomization mechanism, which can produce finer droplet size than by conventional airless spray methods and a feathered spray needed to apply high quality coatings. Without wishing to be bound by theory, the new type of atomization is believed to be produced by the dissolved carbon dioxide suddenly becoming exceedingly supersaturated as the spray mixture experiences a sudden and large drop in pressure in the spray orifice. This creates a very large driving force for gasification of the carbon dioxide. The carbon dioxide gas released from solution during depressurization expands in volume and produces an expansive force that overwhelms the cohesion, surface tension, and viscosity forces that oppose atomization and normally bind the fluid flow together.

A different atomization mechanism is evident because atomization appears to occur right at the spray orifice instead of away from it. Atomization is believed to be due not to break-up of a liquid film from shear with the surrounding air but, instead, to the expansive force of the carbon dioxide gas. Therefore, no liquid film is visible coming out of the nozzle.

Furthermore, because the spray is no longer bound by cohesion and surface tension forces, it typically leaves the nozzle at a much wider angle than normal airless sprays and produces a "feathered" spray with tapered edges like an air spray. This typically produces a rounded, parabolic-shaped spray fan, instead of the sharp angular fans typical of liquid-film sprays. The spray also typically has a much wider fan width than liquid-film sprays produced by the same spray tip. As used herein, the terms "decompressive spray" and "decompressive atomization" each refer to a spray, spray fan, or spray pattern that has the preceding characteristics.

Laser light scattering measurements and comparative spray tests show that this decompressive atomization can produce fine droplets that are in the same size range as air spray systems, instead of the relatively coarse droplets produced by liquid-film airless sprays. For a properly formulated coating composition, the droplet size range and distribution are ideal for minimizing orange peel and other surface defects commonly associated with spray application. This fine particle size provides ample surface area for the dissolved carbon dioxide to very rapidly diffuse from the droplets within a short distance from the spray nozzle. Therefore, the coating is essentially free of carbon dioxide before it is deposited onto the substrate.

Generally, the preferred upper limit of supercritical fluid addition is that which is capable of being miscible with the polymeric coating composition. This practical upper limit is generally recognizable when the admixture containing coating composition and supercritical fluid breaks down from one phase into two fluid phases.

The aforementioned related U.S. Pat. No. 5,178,325, issued Jan. 12, 1993, discloses an improved method for coating substrates by a decompressive spray produced by a supercritical fluid or a subcritical compressed fluid, whereby the average velocity of the decompressive spray is reduced, thereby minimizing the undesirable excessive momentum of the spray as well as the sideways deflection of the spray that occurs as it impacts a substrate. The spray nozzle is comprised of an elongated orifice passageway having a length sufficiently long in relation to the equivalent diameter so as to reduce the average spray velocity of the coating material in the decompressive spray.

Although the supercritical fluid spray methods have been successful, one difficult problem that is created is that the reformulated polymeric composition, which is called a concentrate, has increasingly higher viscosity as higher levels of solvent are removed to further reduce solvent emissions. Concentrate viscosities typically increase from a conventional viscosity of about 40 to 100 centipoise to about 800 to 5000 centipoise or more as more solvent is removed. Therefore, obtaining fine atomization becomes increasingly more difficult. This limits the amount of solvent that can be removed and hence the solids level that can be used in the concentrate. The poorer atomization gives poorer spray application quality, such as poorer coatings. Therefore a need clearly exists for methods by which atomization can be enhanced, when using supercritical fluids or subcritical compressed fluids to spray polymeric compositions, in order to reach higher solids levels and to obtain finer atomization which improves spray application quality.

One method of obtaining finer atomization from a decompressive spray of a polymeric composition is disclosed in U.S. Pat. No. 5,290,603. A spray of finely atomized liquid droplets of a polymeric composition is formed by using combinations of compressed fluid concentration, spray temperature, and spray pressure for which the liquid spray mixture passes through the liquid-liquid region of the phase diagram for the system during depressurization. Without wishing to be bound by theory, enhanced atomization is believed to occur because the dissolved compressed fluid, during depressurization in the spray orifice, nucleates to form a liquid compressed fluid phase before forming gaseous compressed fluid, instead of nucleating directly to a gaseous compressed fluid phase. Nucleation to a liquid compressed fluid phase is much more favorable energetically than to a gas compressed fluid phase. Therefore, nucleation should occur much more quickly during depressurization, that is, at higher pressure because much less supersaturation is required. Furthermore, a much higher concentration of nucleation sites should form in the decompressing fluid. These liquid nucleation sites of liquid compressed fluid readily vaporize to gaseous compressed fluid upon further depressurization, which creates an expansive force that is greater and more widely distributed in the decompressive spray than if the compressed fluid nucleated directly to fewer gas phase sites at a higher degree of supersaturation, that is, at lower pressure. This higher level and better distribution of expansive force is therefore more effective at overcoming the cohesion, surface tension, and viscosity forces that oppose atomization. Therefore, more intense atomization can occur. However, although the method has been effective in enhancing atomization of a decompressive spray, its usefulness has been found to be limited in application, because the spray conditions required are quite narrowly limited. Furthermore, it is not applicable to some polymer systems, because they lack the required phase behavior.

Therefore, a need clearly exists for a more widely applicable method to enhance atomization when using supercritical fluids or subcritical compressed fluids to spray polymeric compositions. Such a method would allow spray application at higher solids levels, to reduce solvent emissions, and with finer atomization, to improve the quality of the application, such as improved coatings. The method would also increase the range of conditions at which a decompressive spray is obtained for a given polymeric composition. This would increase the operating window for commercial use of the spray process, because the application results would become less sensitive to the precision with which the spray conditions could be maintained with commercial spray equipment.

SUMMARY OF THE INVENTION

By virtue of the present invention, methods have been discovered that are indeed able to accomplish the above noted objectives. Polymeric compositions and coating compositions can be sprayed with supercritical or subcritical compressed fluids, such as carbon dioxide, ethane, or nitrous oxide, at higher solids levels, with finer atomization, and with improved spray patterns, such as wider and feathered sprays, over a wider range of spray conditions, to give improved spray application quality with reduced emission of solvent.

In its broadest embodiment, the present invention is directed to a method for spraying a liquid mixture of a polymeric composition and at least one compressed fluid, which compressed fluid is a gas at standard conditions of 0° Celsius and one atmosphere pressure (STP), which comprises passing the liquid mixture under pressure through a first orifice passageway to produce a first spray comprising a liquid-film spray or a transition spray between a liquid-film spray and a decompressive spray, the improvement which comprises providing an elongated first orifice passageway which is elongated in at least an amount such that when spraying the liquid mixture of polymeric composition and at least one compressed fluid through the elongated first orifice passageway, a second spray is produced comprising a decompressive spray or a nearly decompressive spray having smaller average droplet size than the first spray.

In a preferred embodiment, the first orifice passageway has a length which is in the range of from about 0.002 inch to about 0.020 inch and the elongated first orifice passageway has a length which is in the range of from about 0.020 inch to about 0.400 inch.

In another preferred embodiment, the polymeric composition is a coating composition.

In yet another preferred embodiment, the at least one compressed fluid is selected from carbon dioxide, nitrous oxide, ethane, or a mixture thereof.

In still another preferred embodiment, the at least one compressed fluid is a supercritical fluid.

Preferably, the average droplet size of the second spray is less than about 70 percent of the average droplet size of the first spray, more preferably less than about 50 percent.

In another embodiment, the present invention is directed to a method for converting a liquid-film airless spray stream comprised of a mixture of a polymeric composition and at least one compressed fluid, which compressed fluid is a gas at standard conditions of 0° Celsius and one atmosphere pressure (STP) and which stream is formed by passing the mixture under pressure through an orifice passageway, into a decompressive spray or nearly decompressive spray comprising passing the mixture through an orifice passageway having a passageway length L and an equivalent diameter D wherein the-ratio of L:D is in the range of from about 2:1 to about 20:1. Preferably, the ratio of L:D is in the range of from about 3:1 to about 15:1. More preferably, the ratio of L:D is in the range of from about 4:1 to about 10:1.

In a preferred embodiment, the length of the orifice passageway is in the range of from about 0.020 inch to about 0.400 inch.

In still another embodiment, the present invention is directed to a method for spraying a liquid mixture of a polymeric composition and at least one compressed fluid, which compressed fluid is a gas at standard conditions of 0° Celsius and one atmosphere pressure (STP), which comprises passing the liquid mixture under pressure through a first orifice passageway to produce a first spray having a spray pattern with a first width that is about the same as or is narrower than the width of the spray pattern produced by passing the polymeric composition under pressure through the first orifice passageway with no compressed fluid, the improvement which comprises providing an elongated first orifice passageway which is elongated in at least an amount such that when spraying the liquid mixture of polymeric composition and at least one compressed fluid through the elongated first orifice passageway, a second spray is produced having a spray pattern with a second width that is greater than the first width.

In a preferred embodiment, the second width is greater than the width of the spray pattern produced by passing the polymeric composition under pressure through the first orifice passageway with no compressed fluid, preferably more than about 25% greater, more preferably more than about 50% greater, and still more preferably more than about 100% greater.

Here again, in another preferred embodiment, the first orifice passageway has a length which is in the range of from about 0.002 inch to about 0.020 inch and the elongated first orifice passageway has a length which is in the range of from about 0.020 inch to about 0.400 inch.

In yet another embodiment, the present invention is directed to a method for spraying a liquid coating mixture comprising a coating composition and at least one compressed fluid, which compressed fluid is a gas at standard conditions of 0° Celsius and one atmosphere pressure (STP), which comprises passing the liquid coating mixture under pressure through a first orifice passageway to produce a first spray having a fishtail spray pattern, the improvement which comprises providing an elongated first orifice passageway which is elongated in at least an amount such that when spraying the liquid coating mixture of polymeric composition and at least one compressed fluid through the elongated first orifice passageway, a second spray is produced having a feathered spray pattern.

Here yet again, in a preferred embodiment, the first orifice passageway has a length which is in the range of from about 0.002 inch to about 0.020 inch and the elongated first orifice passageway has a length which is in the range of from about 0.020 inch to about 0.400 inch.

In another preferred embodiment, the ratio of the elongated first orifice passageway length to its equivalent diameter is in the range of from about 2 to about 20.

BRIEF DESCRIPTION OF THE DRAWINGS

FIG. 3*a* is a rear plan view of a spray orifice body according to the present invention. FIG. 3*b* is a cross-sectional view taken along line 3*b*—3*b* of FIG. 3*a*.

DETAILED DESCRIPTION OF THE INVENTION

Figure 1:
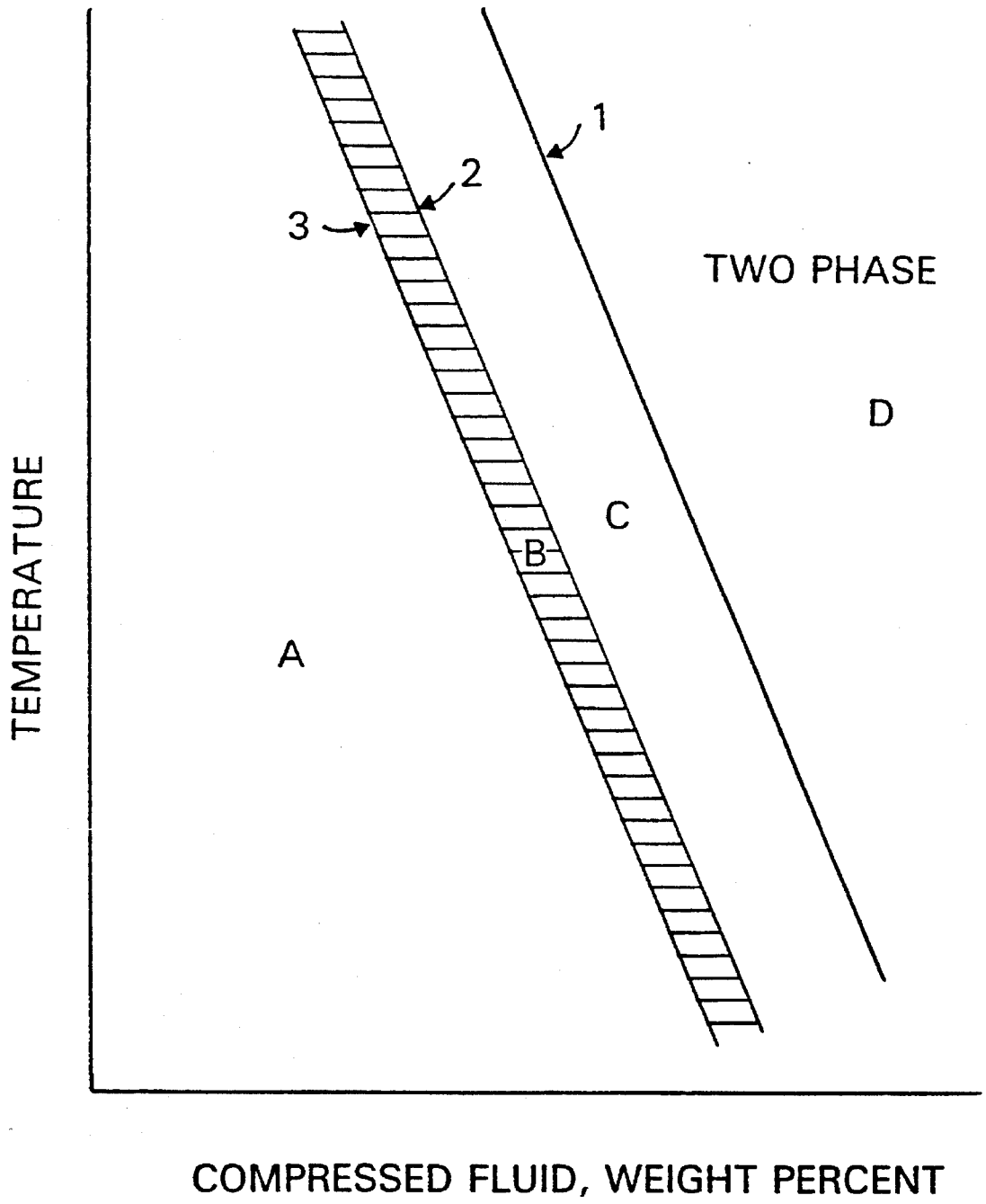
FIG. 1 (PRIOR ART)
FIG. 1 is a temperature-compressed fluid concentration diagram at constant pressure illustrating in general terms the conditions at which liquid-film sprays and decompressive sprays are obtained when a liquid mixture of polymeric composition and compressed fluid are sprayed by using a conventional airless spray orifice of the prior art.

It has been found that, by using the methods of the present invention, polymeric compositions can be sprayed with compressed fluids such as carbon dioxide, nitrous oxide, and ethane at a wider range of conditions with enhanced atomization. This allows the polymeric compositions to be sprayed at higher solids levels, with finer atomization, wider spray patterns, and feathered spray patterns, which improve spray application quality and reduce solvent emissions. The methods increase the range of conditions, namely temperature, pressure, and compressed fluid concentration, at which a decompressive spray can be obtained for a given polymeric composition. This increases the operating window for commercial use of the spray process. The methods are particularly applicable to the spray application of coatings to a substrate.

As used herein, it will be understood that a "compressed fluid" is a fluid which may be in its gaseous state, its liquid state, or a combination thereof, or is a supercritical fluid, depending upon (i) the particular temperature and pressure to which it is subjected, (ii) the vapor pressure of the fluid at that particular temperature, and (iii) the critical temperature and critical pressure of the fluid, but which is in its gaseous state at standard conditions of 0° Celsius temperature and one atmosphere absolute pressure (STP). As used herein, a "supercritical fluid" is a fluid that is at a temperature and pressure such that it is at, above, or slightly below its critical point. As used herein, a "subcritical fluid" is a compressed fluid that is at a temperature and pressure at which it is not a supercritical fluid, whether it be a liquid, a gas, or a gas-liquid mixture.

Compounds which may be used as compressed fluids in the present invention include but are not limited to carbon dioxide, nitrous oxide, ammonia, xenon, ethane, ethylene, propane, propylene, butane, isobutane, chlorotrifluoromethane, monofluoromethane, and mixtures thereof.

Preferably, the compressed fluid has appreciable solubility in the polymeric composition and is environmentally compatible, can be made environmentally compatible by treatment, such as by thermal decomposition or incineration, or can be readily recovered from the spray environment, such as by absorption or adsorption. The utility of any of the above-mentioned compressed fluids in the practice of the present invention will depend upon the polymeric composition used, the temperature and pressure of application, and the inertness and stability of the compressed fluid.

Due to environmental compatibility, low toxicity, and solubility, carbon dioxide, ethane, nitrous oxide, and mixtures thereof are preferred compressed fluids in the present invention. Due to low cost, non-flammability, stability, and wide availability, carbon dioxide is the most preferred compressed fluid. However, use of any of the aforementioned compounds and mixtures thereof are to be considered within the scope of the present invention.

As used herein, the phrase "polymeric composition" is understood to mean conventional polymeric compositions, materials, and formulations that have no compressed fluid admixed therewith. As also used herein, the phrases "coating composition", "coating material", and "coating formulation" are understood to mean liquid compositions comprising conventional coating compositions, materials, and formulations that have no compressed fluid admixed therewith.

As used herein, the term "solvent" is understood to mean conventional solvents that have no compressed fluid admixed therewith and which are in the liquid state at conditions of about 25° C. temperature and one atmosphere absolute pressure. As used herein, the phrase "active solvent" is understood to mean any solvent or mixture of solvents that is miscible with the compressed fluid and is a good solvent for the polymeric compound.

The polymeric compositions that may be used with the present invention are generally comprised of a nonvolatile materials portion containing at least one polymeric compound and which is capable of being sprayed. The polymeric compositions, in addition to the nonvolatile materials portion, may also contain a solvent portion which is at least partially miscible with the nonvolatile materials portion. As used herein, the phrase "nonvolatile materials" is understood to mean solid materials and liquid materials such as solid polymers, liquid polymers, and other compounds that are nonvolatile at a temperature of about 25° Celsius. In general, the non-volatile materials portion is the portion of thee polymeric composition that remains after the solvent portion, if any, has evaporated from the polymeric composition. Examples of polymeric compositions that may be used include coating compositions, adhesives, release agents, additive formulations, gel coats, lubricants, non-aqueous detergents, and other compositions containing polymers, which are capable of being sprayed when admixed with compressed fluid. The polymeric compositions that may be used include liquid compositions that are conventionally sprayed using solvents and in which it is desired to reduce or eliminate the solvent content used for spraying. Also included are polymeric compositions which heretofore could not be sprayed, or could not be sprayed well, because the application or product requires that either no solvent or just a low level of solvent be present in the spray, with the maximum permitted solvent level being too low to obtain sufficiently low viscosity to achieve good atomization of the composition or to obtain a well-formed spray. The polymeric composition may comprise a liquid polymer system that may contain other nonvolatile materials but which has no solvent, or a very low level of solvent.

Polymeric compositions that may be used as polymeric coating compositions with the present invention typically include a nonvolatile materials portion containing at least one polymeric compound which is capable of forming a coating on a substrate, whether such material is a paint, enamel, lacquer, varnish, adhesive, chemical agent, release agent, lubricant, protective oil, non-aqueous detergent, an agricultural coating, or the like.

Generally, the nonvolatile materials used in the polymeric compositions of the present invention, such as the polymers, must be able to withstand the temperatures and pressures to which they are subjected after they are ultimately admixed with the compressed fluid. Such applicable polymers include thermoplastic polymers, thermosetting polymers, crosslinkable film forming systems, and mixtures thereof. The polymers may be liquid polymers or solid polymers and they may be dissolved in solvent.

In particular, the polymeric compounds include vinyl, acrylic, styrenic, and interpolymers of the base vinyl, acrylic, and styrenic monomers; polyesters; oil-free alkyds, alkyds, and the like; polyurethanes, two-package polyurethanes, oil-modified polyurethanes and thermoplastic urethanes systems; epoxy systems; phenolic systems; cellulosic polymers such as acetate butyrate, acetate propionate, and nitrocellulose; amino polymers such as urea formaldehyde, melamine formaldehyde, and other aminoplast polymers and resins materials; natural gums and resins; silicone polymers such as polydimethylsiloxane and other polymers containing silicon; polymers containing fluorine; rubber-based adhesives including nitrile rubbers which are copolymers of unsaturated nitriles with dienes, styrene-butadiene rubbers, thermoplastic rubbers, neoprene or polychloroprene rubbers, waxes, and the like.

In addition to the polymeric compound, the nonvolatile materials portion of the polymeric composition may also comprise other materials, such as nonvolatile organic compounds such as antioxidants, surfactants, ultraviolet absorbers, whiteners, and plasticizers; and nonvolatile inorganic materials such as chemical agents, polymer additives, abrasives, and glass fibers; and the like.

The nonvolatile materials portion of polymeric coating compositions, in addition to the polymeric compound, may contain conventional additives which are typically utilized in coatings. For example, pigments, pigment extenders, metallic flakes, fillers, drying agents, anti-foaming agents, anti-skinning agents, wetting agents, ultraviolet absorbers, cross-linking agents, plasticizers, and mixtures thereof, may all be utilized in the coating compositions to be used with the methods of the present invention.

In addition to the nonvolatile materials portion, a solvent portion may also be employed in the polymeric compositions. The solvent may perform a variety of functions, such as to dissolve the polymer and other components, to reduce viscosity, to give proper flow characteristics, and the like. As used herein, the solvent portion may be essentially any organic solvent or non-aqueous diluent which is at least partially miscible with the nonvolatile materials portion. Preferably, the solvent portion contains at least one active solvent for the polymeric compound. The selection of a particular solvent portion for a given nonvolatile materials portion in order to form a polymeric coating composition or formulation is well known to those skilled in the art of coatings. In general, up to about 30 percent by weight of water, preferably up to about 20 percent by weight, may also be present in a solvent portion comprising organic solvent, provided that a coupling solvent is also present. All such solvent portions are suitable in the present invention.

A coupling solvent is a solvent in which the nonvolatile materials such as polymers are at least partially soluble. Most importantly, however, such a coupling solvent is also at least partially miscible with water. Thus, the coupling solvent enables the miscibility of the nonvolatile materials, the solvent, and the water to the extent that a single liquid phase is desirably maintained such that the composition may optimally be sprayed and, for example, a good coating formed. The coupling solvent also enables miscibility with compressed fluid. Coupling solvents are well known to those skilled in the art of coatings and any conventional coupling solvents which are able to meet the aforementioned characteristics are suitable for being used in the present invention. Applicable coupling solvents include, but are not limited to, ethylene glycol ethers, propylene glycol ethers, and chemical and physical combinations thereof; lactams; cyclic ureas; and the like. When water is not present in the polymeric composition, a coupling solvent is not necessary, but may still be employed.

Other solvents which may be present in typical polymeric compositions, including coating compositions and the like, and which may be utilized in the present invention include ketones such as acetone, methyl ethyl ketone, methyl isobutyl ketone, methyl amyl ketone, cyclohexanone and other aliphatic ketones; esters such as methyl acetate, ethyl acetate, and other alkyl carboxylic esters; ethers, such as methyl t-butyl ether, dibutyl ether, methyl phenyl ether and other aliphatic or alkyl aromatic ethers; glycol ethers such as ethoxy ethanol, butoxy ethanol, ethoxy 2-propanol, propoxy ethanol, butoxy 2-propanol and other glycol ethers; glycol ether esters such as butoxy ethoxy acetate, ethyl 3-ethoxy propionate and other glycol ether esters; alcohols such as methanol, ethanol, propanol, butanol, amyl alcohol and other aliphatic alcohols; aromatic hydrocarbons such as toluene, xylene, and other aromatics or mixtures of aromatic solvents; aliphatic hydrocarbons such as VM&P (Varnish Makers & Painters) naphtha and mineral spirits, and other aliphatics or mixtures of aliphatics; and nitroalkanes such as 2-nitropropane.

For spraying a polymeric composition which may be a coating composition by the methods of the present invention, the polymeric composition is first admixed with at least one compressed fluid to form a liquid mixture under pressure. The liquid mixture is then sprayed by passing the liquid mixture under pressure through an orifice to form a spray.

Compressed fluids have been found to be good viscosity reducing diluents for polymeric compositions such as coating formulations, as disclosed in the aforementioned patents. For example, consider an acrylic coating concentrate that has a viscosity of 1340 centipoise (25° Celsius). Adding carbon dioxide to 30 weight percent concentration reduces the viscosity to below 25 centipoise. Preferably, the viscosity of the liquid mixture of polymeric composition and compressed fluid, when sprayed, is less than about 500 centipoise, more preferably less than about 200 centipoise, still more preferably less than about 100 centipoise, and most preferably less than about 50 centipoise. To minimize solvent usage, the viscosity of the liquid mixture is preferably above about 1 centipoise, more preferably above about 5 centipoise, and most preferably above about 10 centipoise.

The viscosity of the polymeric composition or coating composition before being admixed with the compressed fluid is not narrowly critical for the present invention. The viscosity should be in a range that gives a liquid mixture having a suitable spray viscosity after being admixed with the compressed fluid. The viscosity should also be suitable for the given spray application after the compressed fluid has evaporated from the sprayed composition. Coating compositions should have a suitable viscosity to give proper film coalescence and flowout when deposited on a substrate. Generally, the viscosity of the polymeric composition at a temperature of 25° Celsius should be above about 10 centipoise, preferably above about 50 centipoise, more preferably above about 100 centipoise, still more preferably above about 200 centipoise, and most preferably above about 500 centipoise. Polymeric compositions having very high viscosity above about 10,000 centipoise at a temperature of 25° Celsius may be sprayed by the present invention, but preferably the viscosity is below about 10,000 centipoise, more preferably below about 6000 centipoise, and most preferably below about 3000 centipoise.

Preferably, the compressed fluid has appreciable solubility in the polymeric composition. In general, for the compressed fluid to produce sufficient viscosity reduction and to provide a sufficient expansive force for atomization, the compressed fluid, such as carbon dioxide or ethane, should have a solubility in the polymeric composition of at least about 5 weight percent, based upon the total weight of compressed fluid and polymeric composition, preferably at least about 10 weight percent, more preferably of at least about 20 weight percent, and most preferably of at least about 25 weight percent.

An orifice is a hole or an opening in a wall or housing, such as in a spray tip of a spray nozzle on a spray gun, through which the liquid mixture of polymeric composition and compressed fluid flows in going from a region of higher pressure, such as inside the spray gun, into a region of lower pressure, such as the air environment outside of the spray gun and around a substrate.

The environment into which the polymeric composition is sprayed is not critical. However, the pressure therein must be sufficiently lower than the spray pressure to enable rapid gasification and expansion of the compressed fluid to occur during spray formation. Preferably, the polymeric mixture is sprayed into air under conditions at or near atmospheric pressure. Other gaseous environments can also be used.

The conditions at which liquid-film sprays and decompressive sprays are obtained when a liquid mixture of polymeric composition and compressed fluid is sprayed by a conventional airless spray orifice of the aforementioned prior art can be illustrated in general terms by FIG. 1. The diagram shows how the spray boundaries and the solubility limit of the compressed fluid depend upon the spray temperature and compressed fluid concentration in the liquid spray mixture for constant spray pressure, a given polymeric composition, and a given spray tip. For purposes of illustration, FIG. 1 corresponds to a polymeric composition comprising a single liquid phase, such as polymers fully dissolved in solvents or liquid polymers, but it is readily extended to liquid polymeric compositions containing nonsoluble components dispersed as one or more additional phases, such as pigments in a coating composition.

Line 1 in FIG. 1 is the solubility limit boundary at constant pressure, which divides the combinations of temperature and compressed fluid concentration that give a single liquid phase (regions A, B, and C), wherein the compressed fluid is fully dissolved in the polymeric composition, and those that give two fluid phases (region D), which generally comprise a liquid-liquid mixture or a liquid-gas mixture, depending upon the pressure and the temperature range. A liquid-liquid mixture is formed at higher pressure and lower temperature, whereas a liquid-gas mixture is formed at lower pressure and higher temperature. At some pressures and temperature ranges, the two-fluid-phase region D may comprise a liquid-liquid region and a liquid-gas region separated by a relatively narrow liquid-liquid-gas region. The slope of line 1 shows that the maximum temperature at which a single liquid phase is obtained is lower for higher compressed fluid concentration. At higher pressure, line 1 shifts to higher temperature and compressed fluid concentration, that is, the solubility of the compressed fluid in the polymeric composition is higher. Conversely, lower pressure lowers the solubility limit. The solubility limit curve, line 1, may also have curvature and varying Slope, depending upon the phase diagram. FIG. 1 is understood to represent only a portion of the complete phase diagram for the system. For the present invention, the nature of the phase diagram for a given combination of polymeric composition and compressed fluid is not narrowly critical.

In FIG. 1, the temperatures and compressed fluid concentrations that give a liquid-film spray are denoted by region A, those that give a decompressive spray are denoted by regions C and D, and those that give a transition spray between a liquid-film spray and a decompressive spray are denoted by region B. It is understood that the transition from a liquid-film spray to a decompressive spray and vice versa is a continuous transition for continuous changes in temperature, compressed fluid concentration, or both, and that lines 2 and 3 only represent the approximate boundaries of transition region B for purposes of illustration.

At constant spray temperature and pressure, a liquid-film spray can undergo a transition to a decompressive spray as the compressed fluid concentration in the liquid spray mixture is increased, for suitable polymeric compositions. As shown in FIG. 1, the transition has generally been found to occur over a relatively narrow range of compressed fluid concentration. Furthermore, the decompressive spray region C in which the spray mixture is a one-phase liquid has been found to typically comprise a relatively narrow band of compressed fluid concentration that is just below the solubility limit.

As the compressed fluid concentration increases within region A, the liquid-film spray remains generally angular in shape, has a relatively constant or slightly increased width that is characteristic of the width obtained when the composition is sprayed with no compressed fluid, and has a relatively large average droplet size. A visible liquid film can typically be seen to recede towards the orifice. Atomization occurs predominately due to instability induced by shear with the surrounding air. The spray pattern is controlled predominately by the cohesion, viscosity, and surface tension forces. The boundary of the liquid-film region, denoted by line 3 in FIG. 1, typically occurs about at the compressed fluid concentration at which the liquid film disappears.

As the compressed fluid concentration increases through transition spray region B, the spray pattern typically undergoes dramatic changes, which depend upon the polymeric composition, as it transforms from a liquid-film to a decompressive spray and the atomization mechanism changes. The shape and width of the transition spray typically change markedly for relatively small changes in the compressed fluid concentration. For some polymeric compositions, the spray pattern collapses from a flat fan into a narrower, irregular, conical spray and then expands into a wider, flat, parabolic decompressive spray. Sometimes the spray collapses completely into a single round jet, or into two, three, or more jets spaced at irregular angles, before expanding into a decompressive spray. For other polymeric compositions, the spray pattern remains mostly planar but the center flares outward, more as the spray narrows and then less as the spray expands into a decompressive spray. Sometimes the spray remains planar as a decompressive spray pattern forms superimposed upon the liquid-film spray pattern, which simultaneously disappears. For still other polymeric compositions, the angular spray pattern first becomes much wider and then changes to a parabolic shape. Other transitions may also occur. The transition sprays are irregular and often unstable because neither the expansive force from the release of the gaseous compressed fluid nor the cohesion, viscosity, and surface tension forces of the polymeric composition dominate the atomization and spray pattern formation. The different types of spray transitions are due to different surface tension and rheological properties of different polymeric compositions.

A decompressive spray forms when the compressed fluid concentration becomes high enough for the expansive force of the gaseous compressed fluid to overcome the cohesion, viscosity, and surface tension forces of the polymeric composition in the forming spray. The decompressive spray boundary, line 2, corresponds to the compressed fluid concentration, at constant temperature and pressure, at which the shape and width of the spray pattern first ceases to change markedly in response to relatively small increases in the compressed fluid concentration. At the spray boundary, the decompressive spray is generally substantially planar, mostly parabolic in shape, and significantly wider than the corresponding liquid-film spray. Near the spray boundary, the decompressive spray may have some jetting or be somewhat flared at the center of the spray, and the spray pattern may be fingered. However, these typically dissipate and the spray pattern becomes more uniform at higher compressed fluid concentration. The planar decompressive spray, in addition to being wider, is also characteristically thicker across the plane of the spray than the corresponding liquid-film spray.

One of the important characteristics of the transition from a liquid-film to a decompressive spray is a marked decrease in the average droplet size of the spray. The decompressive spray boundary, line 2, also corresponds about to the compressed fluid concentration, at constant temperature and pressure, at which the droplet size ceases to drop significantly for a relatively small increase in compressed fluid concentration as the spray emerges from the transition region. As the compressed fluid concentration increases within decompressive spray region C, the droplet size continues to decrease, but much more slowly. The droplet size typically reaches a minimum at the two-phase boundary, that is, at the solubility limit, line 1. At typical spray conditions, the two-phase region D often comprises a liquid-liquid region. Spraying significantly inside the two phase region is usually avoided, because a significant amount of solvent is typically extracted from the liquid polymer phase into the liquid carbon dioxide phase, which can significantly increase the viscosity of the liquid spray mixture. This increases the droplet size and causes the spray pattern to deteriorate. Furthermore, for coating applications, film formation usually deteriorates, because the solvent loss causes the deposited coating material to be too viscous to flow out properly.

FIG. 1 shows that changing the spray temperature at constant compressed fluid concentration and pressure can similarly cause the transition from a liquid-film to a decompressive spray and vice versa. The transition has been found to occur over a relatively narrow range of temperature. The transition can also occur by changing both the compressed fluid concentration and temperature at constant pressure.

Examples of decompressive sprays are shown photographically in the aforementioned patents, namely, in FIGS. 3*a*, 3*b*, 3*c*, 3*d*, 3*e*, 10*b*, 11*b*, 12*c*, 12*d*, and 13 of U.S. Pat. No. 5,057,342 and in FIGS. 4*b*, 4*c*, 8, and 9*d* of U.S. Pat. No. 5,009,367. Examples of liquid-film sprays are shown in FIGS. 4*a*, 4*b*, 4*c*, 4*d*, 10*a*, 11*a*, 12*a*, and 12*b* of U.S. Pat. No. 5,057,342 and in FIGS. 3*a*, 3*b*, 3*c*, 9*a*, 9*b*, and 9*c* in U.S. Pat. No. 5,009,367.

U.S. Pat. No. 5,057,342 shows examples of the transition from a liquid-film to a decompressive spray for supercritical carbon dioxide being the compressed fluid. FIGS. 12*a* to 12*d* show the transition for a thermosetting acrylic polymer composition at a temperature of 60° Celsius and a pressure of 1600 psig. FIG. 12*a* shows a liquid-film spray (region A) with 14 percent carbon dioxide (by weight). The liquid film can be seen jetting from the orifice. FIG. 12*b* shows a liquid-film spray at the boundary (line 3) of the transition region, which occurs with about 19.7 percent carbon dioxide. The liquid film has disappeared but the spray is still significantly angular in shape. FIG. 12*c* shows a decompressive spray that forms with about 22 percent carbon dioxide, which is close to the other boundary of the transition region (line 2). The spray flares outward somewhat from the plane of the spray at the center. The angle at which the spray emerges from the orifice is much larger than for a liquid-film spray. FIG. 12*d* shows the uniform decompressive spray that forms with about 25 percent carbon dioxide. FIGS. 11*a* to 11*b* show the transition for an acrylic lacquer polymeric composition. FIG. 11*a* shows a liquid-film spray obtained with 38 percent carbon dioxide at a temperature of 53° Celsius, which is close to the boundary (line 3) of the transition region. FIG. 11*b* shows the decompressive spray (region C) obtained with small increases in compressed fluid concentration and temperature to 40 percent carbon dioxide at 59° Celsius.

The significant decrease in droplet size that occurs in the transition from a liquid-film to a decompressive spray can be illustrated by data that we have measured for an acrylic composition (Rohm & Haas Acryloid™ AT-954), which has 78 percent polymer and a high viscosity of about 2000 centipoise. It was sprayed with carbon dioxide at a constant pressure of 1800 psi. With 24 percent carbon dioxide at a temperature of 50° Celsius, a liquid-film spray was obtained having an average droplet size of 181 microns. Increasing the concentration at constant temperature through the transition region to 26 percent carbon dioxide, which is near the transition boundary (line 2), gave a decompressive spray having an average droplet size of 41 microns. The droplet size of the decompressive spray decreased with higher concentration to a minimum of 24 microns at the solubility limit of 29 percent carbon dioxide. Starting again with 24 percent carbon dioxide, the temperature was increased at constant concentration from 50° to 54° Celsius, which gave a liquid-film spray at the boundary of the transition region (line 3) having an average droplet size of 155 microns. Increasing the temperature to 58° Celsius gave a transition spray (region B) having an average droplet size of 80 microns. Further increasing the temperature to 62° Celsius gave a decompressive spray near the boundary of the transition region (line 2) having an average droplet size of 54 microns. Higher temperature gave decompressive sprays having smaller droplet sizes of 41 microns at 66° Celsius and 33 microns at 70° Celsius (region C). Starting yet again, but at a low temperature of 28° Celsius with 28 percent carbon dioxide, a liquid-film spray was obtained having an average droplet size above 150 microns. Increasing the concentration at constant temperature to 30 percent carbon dioxide gave a decompressive spray having an average droplet size of 42 microns. Higher concentration gave decompressive sprays having smaller droplet sizes of 39 microns at 30 percent and 37 microns at 34 percent carbon dioxide, which was near the solubility limit.

Within the single-liquid phase region, spray pressure generally has much less effect on the transition from a liquid-film to a decompressive spray than the compressed fluid concentration and temperature. The transition with constant compressed fluid concentration but changing temperature and pressure can be illustrated by data that we have measured for a nitrocellulose composition, which had 38 percent polymer and a viscosity of 850 centipoise. It was sprayed at a constant concentration of about 35 percent carbon dioxide. At a temperature of 36° Celsius and a pressure of 965 psi, an angular liquid-film spray was obtained having an average droplet size of 73 microns. At 40° Celsius and 1050 psi, a transition spray was obtained having a droplet size of 48 microns. At 45° Celsius and 1125 psi, a parabolic decompressive spray was obtained having a droplet size of 26 microns. At 65° Celsius and 1750 psi, the decompressive spray had a very fine droplet size of 16 microns.

The transition can also occur with simultaneous changes in concentration, temperature, and pressure. This can be illustrated for another acrylic coating composition containing 67 percent polymer with a viscosity of 670 centipoise. With 28 percent carbon dioxide at 26° Celsius and 1600 psi, an angular liquid-film spray was obtained which deposited a poor coating. With 30 percent carbon dioxide at 28° Celsius and 950 psi, a wide parabolic decompressive spray was obtained which deposited a good coating.

The conditions at which spray patterns having conventional widths and significantly wider widths are obtained when a liquid mixture of polymeric composition and compressed fluid are sprayed by a conventional airless spray orifice of the aforementioned prior art can also be shown in general terms by FIG. 1. The diagram shows how the spray width boundaries depend upon the spray temperature and compressed fluid concentration in the liquid spray mixture for constant spray pressure, a given polymeric composition, and a given spray tip. In region A, conventional spray widths are obtained with compressed fluids which are typically about the same as or are slightly greater than the width obtained when the polymeric composition is sprayed at the same pressure with no compressed fluid, that is, about the same as the spray width rating of the spray tip. Region B is the transition region in which the spray changes from having a conventional width to having a significantly wider width. Often during the transition, the spray width becomes smaller, sometimes much smaller, before it expands to become significantly wider, often much wider. The boundaries of the transition region, lines 2 and 3, can be identified at constant temperature as being the limits of compressed fluid concentration over which relatively small changes in compressed fluid concentration cause relatively large changes in spray width, either larger or smaller. In region C, at higher compressed fluid concentration or higher temperature or both, spray widths are obtained that are significantly larger, often much larger, than those obtained in region A. Wider sprays are also produced in the two-phase region C. These wider sprays are described and shown photographically in the aforementioned U.S. Pat. No. 5,009,367.

The conditions at which fishtail or tailing spray patterns and feathered spray patterns are obtained when a liquid mixture of polymeric composition and compressed fluid are sprayed by a conventional airless spray orifice of the aforementioned prior art can also be shown in general terms by FIG. 1. The diagram shows how the spray pattern boundaries depend upon the spray temperature and compressed fluid concentration in the liquid spray mixture for constant spray pressure, a given polymeric composition, and a given spray tip. In region A, fishtail spray patterns are produced because the concentration of compressed fluid is too low, the temperature is too low, or both are too low, to produce a feathered spray pattern. Region B is the relatively narrow range of conditions at which the spray undergoes a transition from a fishtail spray pattern to a feathered spray pattern. The transition spray pattern is understood to be considered a fishtail spray pattern, because it is not yet a feathered spray pattern. In the transition region, relatively small changes in compressed fluid concentration or temperature can cause relatively large changes in the spray pattern. In region C, at higher compressed fluid concentration or higher temperature or both, feathered spray patterns are produced. Feathered sprays are also produced in the two-phase region D. Feathered and fishtail sprays are described and shown photographically in the aforementioned U.S. Pat. Nos. 5,057,342 and 5,171,613.

It is understood that the transition region for the transition from a liquid-film to a decompressive spray, the transition region for the transition from a conventional spray width to a wider spray width, and the transition region for the transition from a fishtail spray pattern to a feathered spray pattern, that is, the boundaries for a decompressive spray, a wider spray, and a feathered spray, typically occur within similar ranges of compressed fluid concentration and temperature, but they are usually not precisely identical nor are they required to be identical; they can be offset from one another for the same polymeric composition, spray pressure, and spray tip.

When using compressed fluids to spray viscous polymeric compositions such as coating compositions, we have discovered that the concentration of compressed fluid that is necessary to produce sufficient expansive force to form a decompressive spray can be considerably less than was previously thought.

When the aforementioned acrylic composition having 78 percent polymer and high viscosity of about 2000 centipoise was sprayed with carbon dioxide at a temperature of 60° Celsius and a pressure of 1800 psi by using a conventional spray orifice, we found that a minimum of about 24.5 percent carbon dioxide was required to obtain a decompressive spray. This was the decompressive spray boundary (line 2 in FIG. 1). The corresponding solubility limit (line 1) occurred at a concentration of 27.6 percent at 60° Celsius.

However, we have discovered that when the same acrylic composition was sprayed with ethane being the compressed fluid, at the same temperature and pressure and with the same spray tip, a decompressive spray was obtained at a concentration of about 9.5 percent ethane (by weight). Therefore, the decompressive spray boundary (line 2) has shifted to this much lower concentration. Ethane has much lower solubility in this composition than carbon dioxide, so the solubility limit (line 1) has shifted to a much lower concentration of 10.0 percent at 60° Celsius. At these conditions, a feathered, wider, decompressive spray (region C) which was close to the solubility limit had an average droplet size of 36 microns and was used to apply good coatings to a substrate.

These results demonstrate that at the same spray conditions, a decompressive spray can be obtained with just 9.5 percent ethane, whereas 24.5 percent carbon dioxide is required. Therefore, for this polymeric composition, sufficient expansive force is available to produce a decompressive spray with just 9.5 percent compressed fluid, despite the spray solution having much less viscosity reduction than with 24.5 percent compressed fluid. However, if the composition is sprayed with 9.5 percent carbon dioxide, a liquid-film spray is obtained that is far removed from the spray transition region. The carbon dioxide just diffuses from the liquid film outside of the orifice, so the expansive force of the carbon dioxide is not utilized for atomization and spray formation.

We have also discovered that the compressed fluid concentration necessary to form a decompressive spray with conventional spray orifices is higher with lower polymer levels in the polymeric composition, even though the viscosity may be significantly lower. The decompressive spray boundary (line 2) shifts to higher compressed fluid concentration the same way the solubility limit (line 1) shifts due to higher solubility of the compressed fluid at lower polymer levels.

When a second acrylic composition (Rohm & Haas Acroloid™ B-66) having just 38 percent polymer and a much lower viscosity of about 350 centipoise was sprayed with carbon dioxide at a temperature of 60° Celsius and a pressure of 1800 psi by using the same conventional spray orifice, we found that a minimum of about 39.5 percent carbon dioxide was required to obtain a decompressive spray (line 2), which is much higher than the 24.5 percent required for the first acrylic composition having 78% polymer and a viscosity of 2000 centipoise. The solubility limit (line 1) shifted to a higher concentration of about 41.5 percent carbon dioxide at 60° Celsius. Therefore, a much higher carbon dioxide concentration was required to obtain a decompressive spray despite much lower viscosity, because the solubility was much higher, even though the expansive force with 24.5 percent carbon dioxide would be expected to be sufficiently high. However, at 24.5 percent carbon dioxide, a liquid-film spray is obtained that is far removed from the transition spray boundary. The expansive force of the carbon dioxide is not utilized for atomization and spray formation.

Without wishing to be bound by theory, we believe that the decompressive spray region is limited to being close to the solubility limit, when conventional airless spray orifices are used, because during depressurization in these short spray orifices the spray mixture must very rapidly reach the solubility limit and become supersaturated in order to have sufficient time for the dissolved compressed fluid to nucleate to gaseous compressed fluid before the spray mixture flows from the orifice. That is, the transition from a liquid-film to a decompressive spray is limited by the nucleation rate to gaseous compressed fluid and not just by the magnitude of the potential expansive force available due to the compressed fluid concentration. The nucleation time must be fast enough relative to the flow time through the orifice in order to effectively utilize the expansive force of the compressed fluid. Otherwise, if the flow time through the spray orifice is too short for nucleation to occur sufficiently, a liquid-film spray occurs and the dissolved compressed fluid rapidly diffuses from the supersaturated liquid film and expands into the surrounding environment, so that very little of the expansive force is utilized for atomization and spray formation. That the dissolved compressed fluid very rapidly diffuses from the liquid-film is evident from the large temperature drop that has been measured within the liquid film, which is comparable to the temperature drop that occurs from expansion of the gaseous compressed fluid in a decompressive spray having the same compressed fluid concentration. Upon entering the transition region, the nucleation rate becomes fast enough to occur at least partially within the orifice, so the expansive force begins to be utilized for atomization and spray formation. As the nucleation rate increases at higher compressed fluid concentration or higher temperature or both, more nucleation and therefore more gas release occurs within the orifice, so more expansive force is utilized and it becomes more uniformly distributed within the forming spray pattern, which leads to the transformation to a decompressive spray and finer atomization.

We have discovered that a decompressive spray can be obtained at lower compressed fluid concentrations and temperatures, than are obtained with conventional airless spray orifices, by using an elongated orifice passageway to spray the liquid mixture of polymeric composition and compressed fluid. This can be illustrated in general terms by the diagram in FIG. 2. It shows how the spray boundaries and the solubility limit of the compressed fluid depend upon the spray temperature and compressed fluid concentration in the liquid spray mixture for the same pressure, the same polymeric composition, and the same compressed fluid used in FIG. 1, but with the elongated orifice passageway of the present invention. The elongated orifice passageway is elongated in at least an amount such that when the liquid mixture is sprayed through the elongated orifice passageway, a decompressive spray or nearly decompressive spray having smaller average droplet size is produced, whereas at the same compressed fluid concentration and temperature a liquid-film spray or a transition spray is produced with the conventional airless spray orifice passageway used in FIG. 1.

Figure 2:
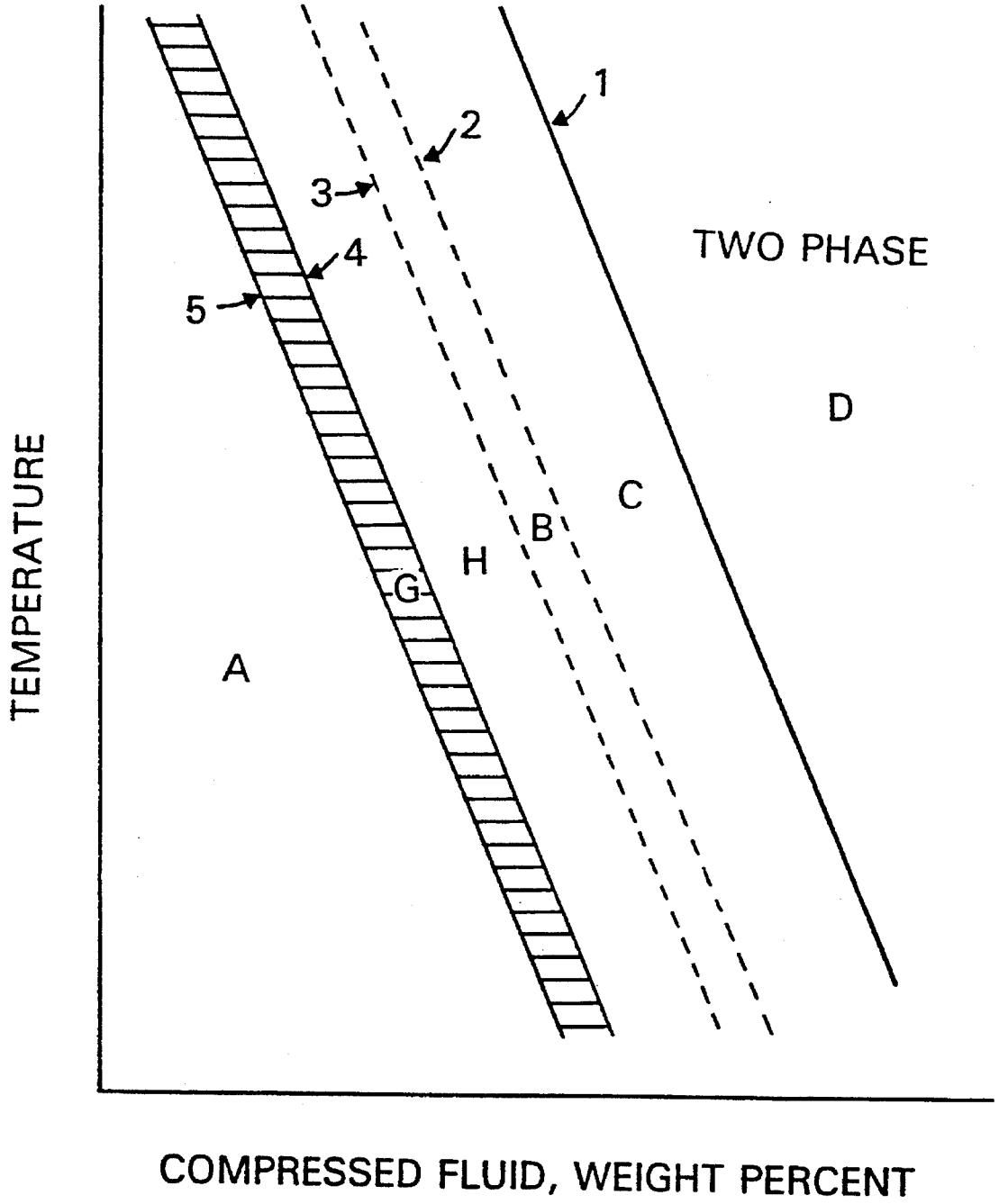
FIG. 2 is a temperature-compressed fluid concentration diagram at constant pressure illustrating in general terms the expanded conditions at which decompressive sprays are obtained by using an elongated airless spray orifice of the present invention.

The solubility limit (line 1) and the two-phase region in FIG. 2 are the same as those in FIG. 1. Regions B and C and boundary lines 2 and 3 from FIG. 1 are shown for reference in FIG. 2, with lines 2 and 3 shown dotted. With the elongated orifice passageway of the present invention, as shown in FIG. 2, a decompressive spray is obtained not only in region C but in regions B and H as well. A liquid-film spray is obtained in region A as before. A transition spray between a liquid-film spray and a decompressive spray is now obtained in region G, which has spray boundary lines 4 and 5, which are analogous to lines 2 and 3 in FIG. 1. The transition region has shifted to lower compressed fluid concentrations and temperatures. With the elongated orifice passageway of the present invention, a decompressive spray is obtained at the compressed fluid concentrations and temperatures in region B in FIG. 2, instead of the transition spray obtained in FIG. 1 with a conventional airless spray orifice passageway, at the same concentrations and temperatures. Similarly, with the elongated orifice passageway, a decompressive spray is obtained at the compressed fluid concentrations and temperatures in region H in FIG. 2, instead of the liquid-film spray obtained in FIG. 1 with a conventional airless spray orifice passageway, at the same concentrations and temperatures. The degree to which the elongated orifice passageway of the present invention shifts the transition region to lower compressed fluid concentrations and temperatures, that is, to what extent a liquid-film spray or a transition spray are transformed into a decompressive spray, will depend upon the length of the elongated orifice passageway, the polymeric composition, the spray pressure, and the compressed fluid used. Without wishing to be bound by theory, it is believed that the elongated orifice passageway of the present invention increases the time available for nucleation to a gaseous compressed fluid phase to occur relatively uniformly within the liquid mixture as it depressurizes in the orifice passageway, because the flow time through the orifice passageway is increased. That is, the flow time can be matched to the nucleation time required for the compressed fluid concentration, temperature, and pressure at which the liquid mixture is sprayed. As the compressed fluid concentration or temperature or both are decreased and move farther from the solubility limit, nucleation to a gas phase occurs more slowly and at lower pressure during depressurization.

A wider spray pattern can also be obtained at lower compressed fluid concentrations and temperatures, than are obtained with conventional airless spray orifices, by using an elongated orifice passageway to spray the liquid mixture of polymeric composition and compressed fluid. This can also be illustrated in general terms by the diagram in FIG. 2. The elongated orifice passageway is elongated in at least an amount such that when the liquid mixture is sprayed through the elongated orifice passageway, a spray is produced having a spray pattern with a second width that is greater than the first width obtained at the same compressed fluid concentration and temperature by using the conventional airless spray orifice passageway in FIG. 1, said first width being about the same as or narrower than the width of the spray pattern produced by passing the polymeric composition under pressure through the conventional airless spray orifice passageway with no compressed fluid.

With the elongated orifice passageway of the present invention, as shown in FIG. 2, a wider spray is obtained not only in region C but in regions B and H as well. Conventional spray widths are obtained in region A as before. The transition between a conventional spray width and a significantly wider spray width is now obtained in region G, with the transition shifted to lower compressed fluid concentrations and temperatures. With the elongated orifice passageway of the present invention, a wider spray is obtained at the compressed fluid concentrations and temperatures in region B in FIG. 2, instead of the narrower widths of the transition spray obtained in FIG. 1 with a conventional airless spray orifice passageway, at the same concentrations and temperatures. Similarly, with the elongated orifice passageway, a wider spray is obtained at the compressed fluid concentrations and temperatures in region H in FIG. 2, instead of the conventional spray widths obtained in FIG. 1 with a conventional airless spray orifice passageway, at the same concentrations and temperatures. The degree to which the elongated orifice passageway of the present invention shifts the transition region to lower compressed fluid concentrations and temperatures, that is, to what extent a conventional spray width or a narrower transition spray width are transformed into a wider spray pattern, will depend upon the length of the elongated orifice passageway, the polymeric composition, the spray pressure, and the compressed fluid used.

A feathered spray pattern can also be obtained at lower compressed fluid concentrations and temperatures than are obtained with conventional airless spray orifices, by using an elongated orifice passageway to spray the liquid mixture of polymeric composition and compressed fluid. This can also be illustrated in general terms by the diagram in FIG. 2. The elongated orifice passageway is elongated in at least an amount such that when the liquid mixture is sprayed through the elongated orifice passageway, a feathered spray pattern is produced, whereas at the same compressed fluid concentration and temperature a fishtail spray pattern is produced by using the conventional airless spray orifice passageway in FIG. 1.

With the elongated orifice passageway of the present invention, as shown in FIG. 2, a feathered spray is obtained not only in region C but in regions B and H as well. Fishtail sprays are obtained in region A as before. The transition between a fishtail spray pattern and a feathered spray pattern is now obtained in region G, with the transition shifted to lower compressed fluid concentrations and temperatures. With the elongated orifice passageway of the present invention, feathered sprays are obtained at the compressed fluid concentrations and temperatures in region B in FIG. 2, instead of the fishtail spray patterns of the transition sprays obtained in FIG. 1 with a conventional airless spray orifice passageway, at the same concentrations and temperatures. Similarly, with the elongated orifice passageway, a feathered spray is obtained at the compressed fluid concentrations and temperatures in region H in FIG. 2, instead of the fishtail sprays obtained in FIG. 1 with a conventional airless spray orifice passageway, at the same concentrations and temperatures. The degree to which the elongated orifice passageway of the present invention shifts the transition region to lower compressed fluid concentrations and temperatures, that is, to what extent a fishtail spray pattern is transformed into a feathered spray pattern, will depend upon the length of the elongated orifice passageway, the polymeric composition, the spray pressure, and the compressed fluid used.

The present invention may also be used with polymeric compositions for which conventional airless spray orifices do not produce a decompressive spray when sprayed with compressed fluids. That is, with polymeric compositions that do not produced a decompressive spray region C at compressed fluid concentrations and temperatures that are below the solubility limit (line 1) and within the single liquid phase region in FIG. 1. By use of the elongated orifice passageway of the present invention, decompressive sprays can be obtained with such polymeric compositions. Similarly, the present invention may also be used with polymeric compositions for which conventional airless spray orifices do not produce a wider spray or a feathered spray when sprayed with compressed fluids.

The elongated orifice passageway of the present invention must be sufficiently long relative to the equivalent diameter to effectively produce the decompressive spray, wider spray, or feathered spray, but it must not be so excessively long that an excessive amount of the compressed fluid is converted to a gas while still within the orifice so that the expansive force is severely depleted before the spray is discharged from the orifice. Preferably, the ratio of length to diameter is greater than about 2 and less than about 20, more preferably greater than about 3 and less than about 15, most preferably greater than about 4 and less than about 10. So too, the length of the elongated orifice passageway should desirably be in the range of from about 0.020 inch to about 0.400 inch, and more preferably from about 0.040 inch to about 0.300 inch. This is in contrast to the conventional length of the prior art orifice passageways which typically is in the range of from about 0.002 inch to about 0.020 inch.

The orifice sizes suitable for the practice of the present invention generally range from about 0.004 inch to about 0.030 inch diameter. Because the orifices are generally not circular in cross-section, the diameters referred to are equivalent to a circular diameter. The proper selection is determined by the orifice size that will supply the desired amount of liquid coating and accomplish proper atomization for the coating. Orifice sizes of from about 0.007 inch to about 0.025 inch equivalent diameter are preferred, although smaller and larger orifice sizes may be used. Orifice sizes of from about 0.009 inch to about 0.020 inch equivalent diameter are more preferred.

The feed passageway to the inlet of the elongated orifice passageway desirably has a significantly larger cross-sectional area than the orifice passageway, so that the flow resistance in the feed passageway is small compared to the flow resistance in the orifice passageway to prevent a significant loss of pressure before the liquid mixture enters the spray orifice passageway. However, the flow path from the flow control valve, which turns the spray on and off, to the spray orifice passageway desirably has minimal overall volume to promote clean valving of the liquid spray mixture.

Although the spray tip body containing the spray orifice may be constructed to produce a round or oval spray pattern, preferably the spray tip body of the spray nozzle assembly contains a groove cut transversely across the outlet of the elongated orifice passageway so as to shape the decompressive spray, wider spray, or feathered spray into a relatively flat spray fan. Preferably the groove is v-shaped or similar shaped such that the angle of the groove regulates the width of the spray fan produced, as is known to those skilled in the art.

A spray orifice body 100 that embodies the concepts of the present invention is illustrated in FIGS. 3*a* and 3*b*. FIG. 3*a* shows a rear plan view and FIG. 3*b* shows a cross-sectional view along line 3*b*—3*b* in FIG. 3*a*. It has a feed passageway 110 that feeds into a circular elongated orifice passageway 120. A v-shaped groove 130 is cut through the discharge end of the orifice passageway to shape the spray into a relatively flat fan. Orifice passageway 120 has a ratio of length to equivalent diameter of about 5. The elongated orifice passageway provides a sufficiently long flow time for the dissolved compressed fluid to nucleate to form a gaseous phase dispersed relatively uniformly within the flow during depressurization without forming an excessive amount of gas so that the expansive force is severely depleted before the spray is discharged from the orifice. The spray mixture discharges from orifice passageway 120 as a decompressive spray, a wider spray, or a feathered spray.

Figure 4A:
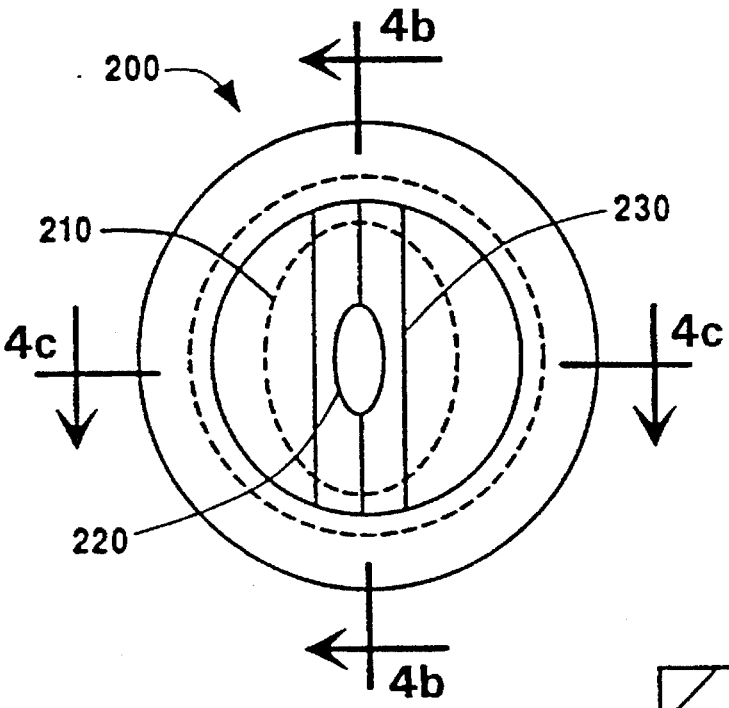
FIG. 4*a* is a front plan view of another spray orifice body according to the present invention.
Figure 4B:
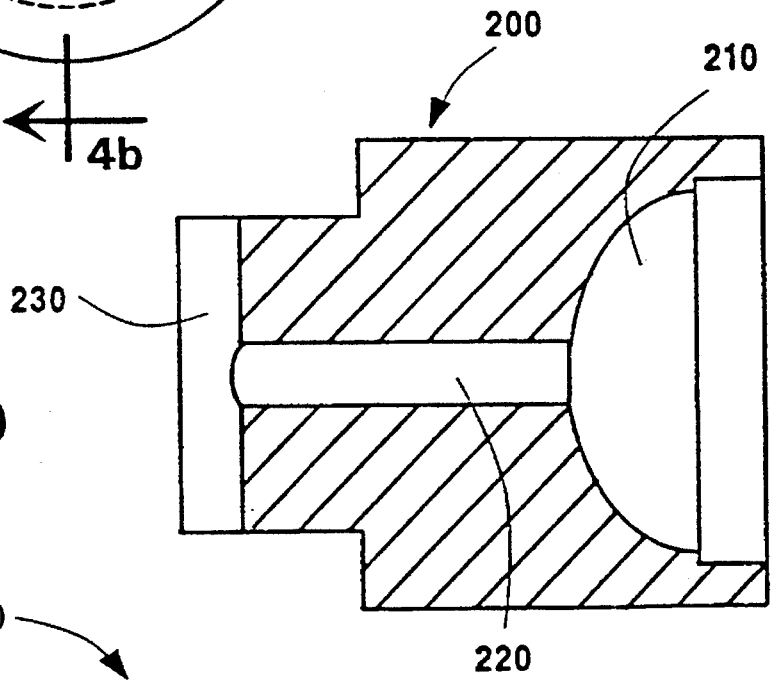
FIGS. 4*b* and 4*c* are cross-sectional views along lines 4*b*—4*b* and 4*c*–4*c*, respectively, of FIG. 4*a*.
Figure 4C:
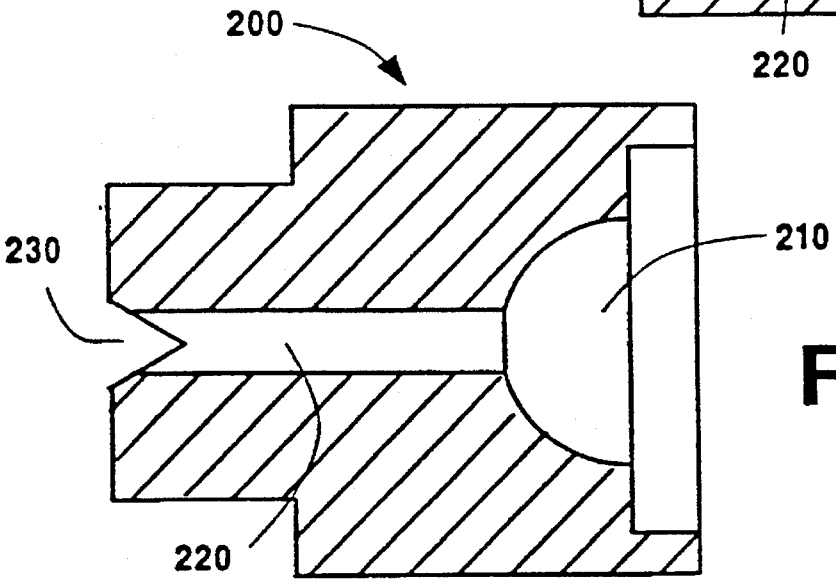

Another spray orifice body that embodies the concepts of the present invention is illustrated in FIGS. 4*a*, 4*b*, and 4*c*. FIG. 4*a* shows a front plan view and FIGS. 4*b* and 4*c* show cross-sectional views along lines 4*b*—4*b* and 4*c*—4*c*, respectively, in FIG. 4*a*. A feed passageway 210 feeds into an elliptical elongated orifice passageway 220. A v-shaped groove 230 is cut through the discharge end of the orifice passageway to shape the spray into a relatively flat fan. Orifice passageway 220 has a ratio of length to equivalent diameter of about 5. The elongated orifice passageway provides a sufficiently long flow time for the dissolved compressed fluid to nucleate to form a gaseous phase dispersed relatively uniformly within the flow during depressurization without forming an excessive amount of gas so that the expansive force is severely depleted before the spray is discharged from the orifice. The spray mixture discharges from orifice passageway 210 as a decompressive spray, a wider spray, or a feathered spray.

It will be readily apparent that the specific curvature or convergence of the sidewalls and edge portions of the feed passageway and the elongated orifice passageway may be modified or altered from that shown to other geometric designs or configurations to produce different specific discharge patterns or to effect different volumetric fluid flow. Likewise, the effective diameters of the feed passageway and orifice passageway and their ratio with respect to each other may be changed without departing from the spirit and scope of the invention.

Conventional and electrostatic airless spray nozzle assemblies and spray guns may be assembled with the spray orifice body of the present invention as is known to those skilled in the art provided they meet the requirements of clean valving and do not interfere with the wide angle at which the decompressive spray leaves the spray orifice. The spray guns, spray nozzle assemblies, and spray orifice bodies must be built to contain the spray pressure used. The most preferred spray tip assemblies and spray guns are the UNI-CARB® spray tip assemblies and spray guns manufactured by Nordson Corporation for spraying coating compositions with compressed fluids. The material of construction of the spray orifice body must possess the necessary mechanical strength for the high spray pressure, have sufficient abrasion resistance to resist excessive wear from fluid flow, and be inert to chemicals with which it comes into contact. Any of the materials used in the construction of airless spray tips, such as boron carbide, titanium carbide, ceramic, stainless steel or brass, and the like, is suitable, with tungsten carbide generally being preferred for greater wear resistance.

Turbulence promoters are not required in the practice of the present invention, but the aforementioned devices and flow designs, such as pre-orifices or turbulence promoters, that promote turbulent or agitated flow in the liquid mixture prior to passing the mixture through the elongated orifice may be used. They preferably do not create an excessively large pressure drop in the flow of the liquid mixture. Pre-orifices can be useful with high molecular weight polymeric compositions, because they pre-shear the composition before it is sprayed, thereby changing the rheology of the liquid mixture.

The liquid mixture of polymeric composition and compressed fluid may be prepared for spraying by any of the spray apparatus disclosed in the aforementioned patents or other apparatus. The spray apparatus may also be a UNI-CARB® System Supply Unit manufactured by Nordson Corporation to proportion, mix, heat, and pressurize polymeric compositions with compressed fluids such as carbon dioxide for the spray application of coatings.

Although high spray pressures of 5000 psi and higher may be used, preferably the spray pressure is below about 3000 psi, more preferably below about 2000 psi. Very low pressure is generally not compatible with high compressed fluid solubility in the polymeric composition. Therefore, preferably the spray pressure is above about 50 percent of the critical pressure of the compressed fluid, more preferably above about 75 percent of the critical pressure, and most preferably above, at, or slightly below the critical pressure.

Preferably, the spray temperature of the liquid mixture is below about 150° Celsius, more preferably below about 100° Celsius, and most preferably below about 80° Celsius. The temperature level that may be utilized will in general depend upon the stability of the polymeric system. Reactive systems must generally be sprayed at lower temperature than non-reactive systems like air-dry lacquers. Preferably, the spray temperature of the liquid mixture is above about 20° Celsius, more preferably above about 25° Celsius, and most preferably above, at, or slightly below the critical temperature of the compressed fluid. The liquid mixture is preferably heated to a temperature that substantially compensates for the drop in spray temperature that occurs due to expansion cooling of the decompressing compressed fluid.

Generally, liquid spray droplets are produced which generally have an average diameter of one micron or greater. Preferably, the droplets have average diameters of about 5 to about 100 microns, more preferably from about 10 to about 50 microns.

The polymeric composition may comprise a coating composition and the liquid sprays produced by the present invention may be used to apply coatings to a substrate, as taught in the aforementioned patents.

While preferred forms of the present invention have been described, it should be apparent to those skilled in the art that methods and apparatus may be employed that are different from those described and shown without departing from the spirit and scope thereof.

What is claimed is:

1. In a method for spraying a liquid mixture of a polymeric composition and at least one compressed fluid, which compressed fluid is a gas at standard conditions of 0° Celsius and one atmosphere pressure (STP), which comprises passing the liquid mixture under pressure through a first orifice passageway to produce a first spray comprising a liquid-film spray or a transition spray between a liquid-film spray and a decompressive spray, the improvement which comprises providing an elongated first orifice passageway which is elongated in at least an amount such that when spraying the liquid mixture of polymeric composition and at least one compressed fluid through the elongated first orifice passageway, a second spray is produced comprising a decompressive spray or a nearly decompressive spray having smaller average droplet size than the first spray.

2. The method of claim 1, wherein the first orifice passageway has a length which is in the range of from about 0.002 inch to about 0.020 inch and the elongated first orifice passageway has a length which is in the range of from about 0.020 inch to about 0.400 inch.

3. The method of claim 2, wherein the elongated first orifice passageway has an equivalent diameter in the range of from about 0.004 inch to about 0.030 inch.

4. The method of claim 1, wherein the polymeric composition is a coating composition.

5. The method of claim 1, wherein the at least one compressed fluid is selected from carbon dioxide, nitrous oxide, ethane, or a mixture thereof.

6. The method of claim 1, wherein the at least one compressed fluid is a supercritical fluid.

7. The method of claim 1, wherein the ratio of the elongated first orifice passageway length to its equivalent diameter is in the range of from about 2 to about 20.

8. The method of claim 1, wherein the average droplet size of the second spray is less than about 70 percent of the average droplet size of the first spray.

9. A method for converting a liquid-film airless spray stream comprised of a mixture of a polymeric composition and at least one compressed fluid, which compressed fluid is a gas at standard conditions of 0° Celsius and one atmosphere pressure (STP) and which stream is formed by passing the mixture under pressure through an orifice passageway, into a decompressive spray or nearly decompressive spray comprising passing the mixture through an orifice passageway having a passageway length L and an equivalent diameter D wherein the ratio of L:D is in the range of from about 2:1 to about 20:1.

10. The method of claim 9, wherein the length of the orifice passageway is in the range of from about 0.020 inch to about 0.400 inch.

11. The method of claim 10, wherein the equivalent diameter of the orifice passageway is in the range of from about 0.004 inch to about 0.030 inch.

12. The method of claim 10, wherein the polymeric composition is a coating composition.

13. In a method for spraying a liquid mixture of a polymeric composition and at least one compressed fluid, which compressed fluid is a gas at standard conditions of 0° Celsius and one atmosphere pressure (STP), which comprises passing the liquid mixture under pressure through a first orifice passageway to produce a first spray having a spray pattern with a first width that is about the same as or is narrower than the width of the spray pattern produced by passing the polymeric composition under pressure through the first orifice passageway with no compressed fluid, the improvement which comprises providing an elongated first orifice passageway which is elongated in at least an amount such that when spraying the liquid mixture of polymeric composition and at least one compressed fluid through the elongated first orifice passageway, a second spray is produced having a spray pattern with a second width that is greater than the first width.

14. The method of claim 13, wherein the second width is greater than said width of the spray pattern produced by passing the polymeric composition under pressure through the first orifice passageway with no compressed fluid.

15. The method of claim 13, wherein the first orifice passageway has a length which is in the range of from about 0.002 inch to about 0.020 inch and the elongated first orifice passageway has a length which is in the range of from about 0.020 inch to about 0.400 inch.

16. The method of claim 13, wherein the ratio of the elongated first orifice passageway length to its equivalent diameter is in the range of from about 2 to about 20.

17. In a method for spraying a liquid coating mixture comprising a coating composition and at least one compressed fluid, which compressed fluid is a gas at standard conditions of 0° Celsius and one atmosphere pressure (STP), which comprises passing the liquid coating mixture under pressure through a first orifice passageway to produce a first spray having a fishtail spray pattern, the improvement which comprises providing an elongated first orifice passageway which is elongated in at least an amount such that when spraying the liquid coating mixture of polymeric composition and at least one compressed fluid through the elongated first orifice passageway, a second spray is produced having a feathered spray pattern.

18. The method of claim 17, wherein the first orifice passageway has a length which is in the range of from about 0.002 inch to about 0.020 inch and the elongated first orifice passageway has a length which is in the range of from about 0.020 inch to about 0.400 inch.

19. The method of claim 17, wherein the ratio of the elongated first orifice passageway length to its equivalent diameter is in the range of from about 2 to about 20.

20. The method of claim 17, wherein the at least one compressed fluid is a supercritical fluid.

* * * * *